US005355288A

United States Patent [19]

Maddock

[11] Patent Number: 5,355,288

[45] Date of Patent: Oct. 11, 1994

[54] LAMPHOLDER AND MOUNTING MEANS THEREFOR

[75] Inventor: William H. Maddock, Toronto, Canada

[73] Assignee: Noma, Inc., Scarborough, Canada

[21] Appl. No.: 49,335

[22] Filed: Apr. 21, 1993

[51] Int. Cl.[5] ..... F21V 1/00

[52] U.S. Cl. ..... 362/238; 362/396; 362/806; 439/575

[58] Field of Search ..... 362/123, 806, 122, 121, 362/250, 249, 238, 396; 439/575, 574, 576; 248/221.4

[56] References Cited

U.S. PATENT DOCUMENTS

| | | | |
|---|---|---|---|
| Re. 28,710 | 2/1976 | Finkelstein | 439/575 |
| 2,057,078 | 10/1936 | Abramson | 439/575 |
| 2,183,377 | 12/1939 | Wolf | 439/575 |
| 2,299,733 | 1/1941 | Benander | 173/358 |
| 2,453,695 | 11/1948 | Belling | 362/123 |
| 2,889,451 | 3/1958 | Longo | 240/52 |
| 3,189,310 | 5/1962 | Trueson | 243/314 |
| 3,341,699 | 11/1966 | Somermeyer | 240/2 |
| 3,678,443 | 7/1972 | Koehler | 339/119 L |
| 3,836,760 | 9/1974 | Robinson | 240/10 R |
| 3,883,926 | 5/1975 | Reynolds | 24/73 |
| 4,491,902 | 1/1985 | Cangelosi | 362/389 |
| 4,667,276 | 5/1987 | Cheng | 362/249 |
| 4,802,072 | 1/1989 | Kau | 362/806 |
| 5,021,706 | 6/1991 | Chen | 313/318 |
| 5,024,406 | 6/1991 | Ketcham | 248/149 |

*Primary Examiner*—James C. Yeung
*Attorney, Agent, or Firm*—Kenneth M. Garrett

[57] ABSTRACT

A lampholder for use with e.g. a string of outdoor Christmas decorative lamps includes a pair of jaws forming a clip for supporting the lampholder from an elongated support frame to create a decorative display. At least one of the jaws is provided with a recess in medial portions to adapt the clip for gripping the head of a screw from which the lampholder may alternatively be supported.

13 Claims, 2 Drawing Sheets

LAMPHOLDER AND MOUNTING MEANS THEREFOR

FIELD OF INVENTION

This invention relates to improvements to lampholders that may form part of decorative light strings such as are commonly used for festive occasions.

It particularly relates to improvements for supporting the lampholders from support elements which may in their turn be supported from a basic support structure such as a building facade.

BACKGROUND OF INVENTION

Decorative light strings, as this term is used herein, comprise a plurality of lampholders connected together by electrical conductors in a flexible string. The lampholders include an insulating body portion having a socket opening defining an axial direction for receiving a lamp therein. One such exemplary lampholder and light string is disclosed in U.S. Pat. No. 4,778,409 (Maddock) the contents of which are incorporated herein by reference thereto.

Various means are known or have been proposed for retaining the lampholders in detachable position on support elements. Where the support element is thin and elongated in a direction generally orthogonal to the axis of the lampholder, clip means is used. The clip means typically includes a pair of stiffly resilient, mutually opposed jaws which are rooted to the body of the lampholder, to permit the lampholder to be attached anywhere along the support element. Lampholders incorporating this type of clip means are described in U.S. Pat. No. 3,678,443 to Koehler, commonly assigned herewith.

In accordance with a second method, as exemplified by U.S. Pat. No. 2,889,451 to Longo, the lampholders are attachable to support elements located at predetermined spots on a support structure. This method of attachment necessitates the use of a two part snap connector, the one part (a base) being permanently secured to the support structure at the predetermined spot, the other part being secured to the lampholder, normally being integrally formed therewith.

The clip means described in the first of the above mentioned methods is not amenable for use with the spot attachment method, and vice versa.

There is no interchangeability with the various two part connectors used in the spot attachment method; accordingly, the lampholders of one manufacturer are unlikely to be of use with the base connectors of another manufacturer.

It is an object of this invention to provide improved lampholders and festive light strings incorporating such lampholders which may be attached to elongated support elements or spot support elements as desired.

It is another object of this invention to provide improved lampholders of the foregoing nature which are adapted for use with spot support base elements which are of a ubiquitous, non-proprietary nature.

SUMMARY OF INVENTION

In accordance with the invention, a lampholder for a festive light includes an insulated body portion having an axis along which the lamp is received in the lampholder, and a pair of stiffly resilient jaws rooted to the body to extend outwardly therefrom with major surface portions thereof in mutual opposition to form a passageway within which an elongated support element extending in a first direction generally orthogonal to the axis of the body is receivable for gripping by the jaws. The lampholder is characterized wherein at least one of the jaws, in a medial portion of the major surface portion thereof forming a part of the passageway, is provided with a small annular recess, thereby adapting the jaws to grip a spot support element, which may be in the nature of the head of a simple screw secured to the basic support structure, and to resist lateral forces that would otherwise tend to disengage the jaws from their gripping relationship with the screw head.

Suitably, at least for the purposes of facilitating the manufacture of the lampholder, the recess will communicate with opposed major surfaces of the jaw in which it is disposed.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 2:
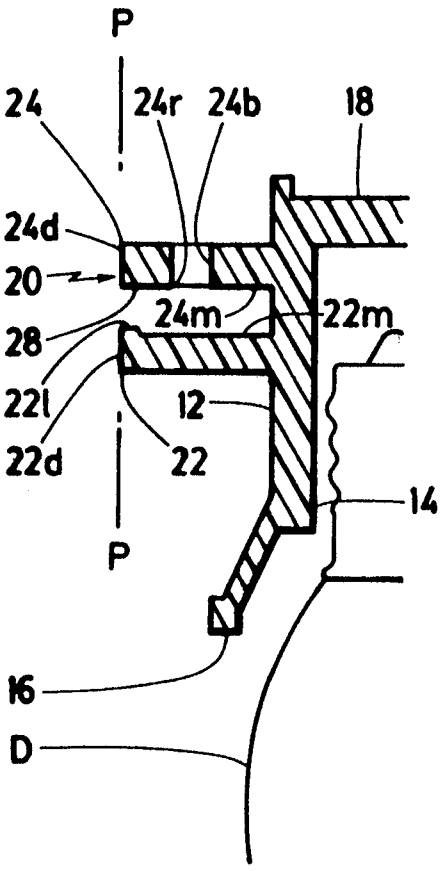
FIG. 2 is a section through 2—2 of a lampholder of FIG. 1; together with a lamp, on enlarged scale.
Figure 1:
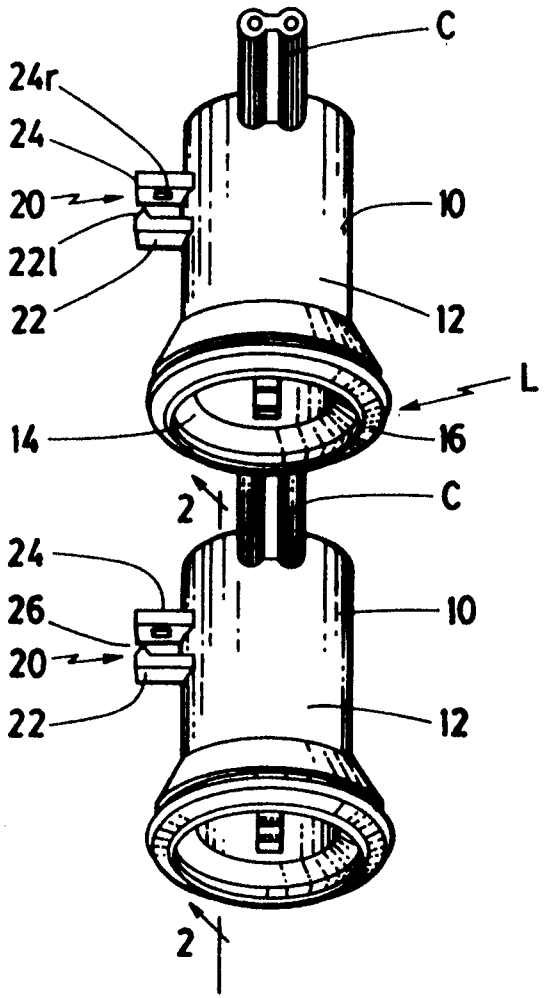
FIG. 1 shows in perspective view a pair of lampholders in accordance with the invention coupled together with an electrical cord to form part of a string of decorative lights.

Referring to the drawings in detail, a lampholder in accordance with the invention is identified generally therein by the numeral 10. Lampholder 10 comprises a hollow insulated body 12 having a socket opening 14 at one axial end 16 thereof into which a decorative lamp D is receivable, and a base 18 defining the other axial end of the lampholder. A flexible electrical cord C connects lampholders 10 together to form part of a string of lights L in a manner well known in the art. A clip means 20 comprises a pair of jaws 22, 24 rooted to body 12 adjacent base 18 to project radially outwardly from the body in mutually opposed, axially spaced confronting relationship. Jaws 22, 24 have a distal end, respectively identified as **22*d*, 24*d*, distal end 22*d* having a lip portion 22*l* which restricts the entrance 26 to a passageway 28 between the jaws. The jaws 22, 24 are radially outwardly coextensive whereby distal ends 22*d*, 24*d* terminate in a plane P—P parallel to the axis of body 12. Generally speaking body 12 and jaws 22, 24** will be unitarily moulded from a stiffly resilient, electrically insulating material such as polypropylene.

Jaws 22, 24 each have a major surface **22*m*, 24*m*, to define walls of passageway 28, which surfaces are in mutual opposition; one of the opposed surfaces, in this instance 24*m*, is provided with a small rectangular recess 24r in a medial portion thereof, which recess connects to a bore 24b having a similar dimension to that of the associated recess so as to form a continuum thereof, which bore passes completely through the jaw 24 transversely to major surface 24m** thereof.

Figure 4:
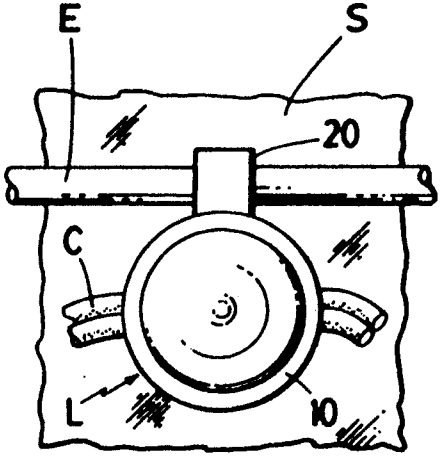
FIG. 4 is similar to FIG. 3, but shows the lampholder in an alternative position of attachment to the support element.
Figure 3:
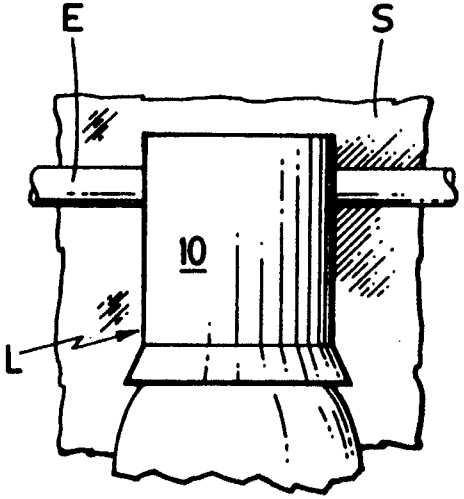
FIG. 3 shows a lampholder of FIG. 1 in front elevation, attached to a fragment of an elongated support element shown together with underlaying support structure.

The string of lights L of the invention may be used in traditional manners for example by draping about the branches of a tree, or with the electrical cord secured to a support structure by stapling or the like in a semi-permanent arrangement. In using the light string L to form an easily attachable and detachable display in accordance with the manner set forth in the aforementioned Koehler patent, elongated support elements E are first erected from a support structure S such as a building facade in the manner set forth in the patent, and jaws 22, 24 serve to clip lampholders 10 thereto. Suitably the support elements will be held in spaced apart relationship from support structure S, which will permit the clip means 20 to engage with a support element with the axis of the lampholder 10 being downwardly directed, as suggested by FIG. 3, (or equally upwardly directed) or outwardly directed, as suggested by FIG. 4.

Figure 5:
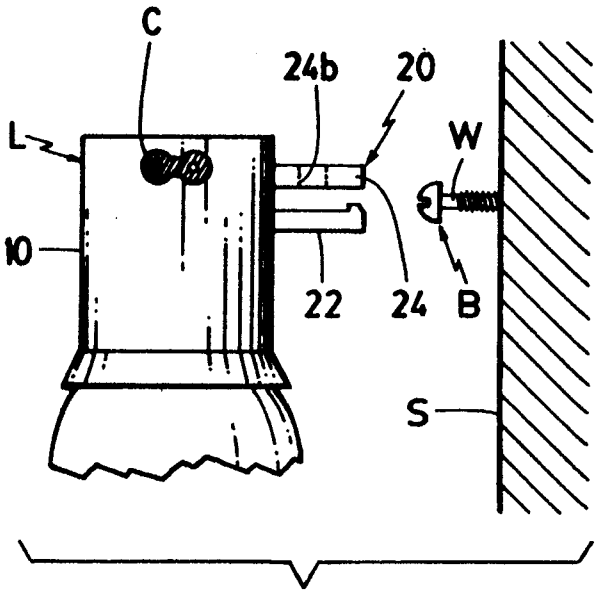
FIG. 5 shows the lampholder of FIG. 1 in side elevation, in position to attach to a screw head secured to a fragment of a support structure.

An alternative method of attaching light string L (or individual lampholders 10 thereof) to a support structure S in accordance with the invention is shown in FIG. 5 wherein a simple round or flat headed wood screw W forming a base B is partly screwed into the support structure, the head of the screw being receivable in recess 24r in gripping relationship.

It will be apparent that many changes may be made to the illustrative embodiment while falling within the scope of the invention, and it is intended that all such changes be covered by the claims appended hereto.

I claim:

1. A lampholder for a festive string of lights, said lampholder comprising:

an insulated body portion into which a lamp forming a part of said festive string of lights may be inserted, and clip means comprising a pair of stiffly resilient jaws rooted to said insulated body portion to extend outwardly therefrom along an axis;

said jaws having major surface portions in spaced apart, mutually confronting relationship to form a passageway therebetween;

at least one of said jaws having a small recess disposed in medial portions of said major surface portion thereof; said major surface portion in which said recess is disposed being devoid of any spur-like projection into said passageway associated with said recess;

said clip means thereby being adapted to grip either of a rod-like support element of indefinite length or the head of a screw support element received between said jaws.

2. A lampholder as defined in claim 1, wherein said recess connects to a bore extending through the jaw in which said recess is disposed transversely to the major surface thereof to provide a continuous opening through said jaw.

3. A lampholder as defined in claim 1, wherein said jaws extend radially outwardly from said body portion.

4. A lampholder as defined in claim 3, wherein said jaws are radially outwardly coextensive.

5. A lampholder as defined in claim 4, wherein the distal end of at least one of said jaws is provided with a lip to restrict the entrance to said passageway.

6. A lampholder as defined in claim 4, wherein the distal end of one of said jaws opposed to said jaw in which said recess is disposed is provided with a lip to restrict the entrance to said passageway.

7. A lampholder as defined in claim 1, wherein said jaws are rooted to said body portion remote from a said lamp when inserted into said lampholder.

8. A lampholder as defined in claim 1, wherein said recess connects to a bore extending through the jaw in which said recess is disposed transversely to the major surface thereof to provide a continuous opening through said jaw.

9. A lampholder as defined in claim 1 wherein said jaws are unitarily formed with said body portion by molding.

10. A lampholder for a festive light string, said lampholder comprising:

an insulated body portion defining a socket including an opening into which a lamp forming a part of said decorative light string is insertable, and clip means unitarily formed with said body portion;

said clip means comprising a pair of jaws extending radially outwardly from said body portion remote from said opening;

each said jaw having a major surface, with said major surfaces being in spaced apart mutually confronting relationship to define a passageway between said jaws;

at least one said jaw having a recess in a medial portion of the major surface associated therewith;

said recess having a perimeter therearound contained entirely within said major surface;

said clip means thereby being adapted to grip either of a rod-like support element of indefinite length or the head of a screw support element received between said jaws.

11. A lampholder as defined in claim 10, wherein said jaws are radially outwardly coextensive.

12. A lampholder as defined in claim 11, wherein the distal end of at least one of said jaws is provided with a lip to restrict the entrance to said passageway.

13. A lampholder as defined in claim 10 wherein said clip means is unitarily formed with said body portion by molding.

* * * * *